US006640997B1

(12) United States Patent
Anderson

(10) Patent No.: US 6,640,997 B1
(45) Date of Patent: Nov. 4, 2003

(54) FLUID DISPENSING SYSTEM

(76) Inventor: Harlan D. Anderson, 25274-465th Ave., Hartford, SD (US) 57033

( * ) Notice: Subject to any disclaimer, the term of this patent is extended or adjusted under 35 U.S.C. 154(b) by 92 days.

(21) Appl. No.: 09/965,010

(22) Filed: Sep. 27, 2001

(51) Int. Cl.[7] ..... B67D 5/10; B67D 5/12

(52) U.S. Cl. ..... 222/2; 222/66; 222/642; 222/75; 222/180; 222/153.03; 222/182

(58) Field of Search ..... 222/2, 23, 32, 222/66, 74, 75, 174, 180, 153.03, 182, 189.11, 372, 526, 538, 639, 642; 312/100, 245; 248/218.4, 219.4, 300, 311.2

(56) References Cited

U.S. PATENT DOCUMENTS

| | | | | | |
|---|---|---|---|---|---|
| 1,913,128 | A | * | 6/1933 | Peter | 222/71 |
| 3,318,732 | A | | 5/1967 | French | |
| 3,570,644 | A | | 3/1971 | Booth | |
| 3,845,848 | A | | 11/1974 | Robbins | |
| 3,895,268 | A | * | 7/1975 | May et al. | 361/837 |
| 4,070,074 | A | * | 1/1978 | Rohme | 312/245 |
| D272,628 | S | | 2/1984 | Monigle et al. | |
| D273,790 | S | | 5/1984 | Monigle et al. | |
| 4,726,492 | A | * | 2/1988 | Komukai | 222/14 |
| 4,880,144 | A | | 11/1989 | Shea | |
| 5,018,645 | A | | 5/1991 | Zinsmeyer | |
| 5,497,914 | A | | 3/1996 | Maltsis | |
| 5,685,435 | A | * | 11/1997 | Picioccio et al. | 209/677 |
| 5,957,329 | A | | 9/1999 | Kenney et al. | |
| 5,967,366 | A | | 10/1999 | Cason | |
| 6,061,989 | A | * | 5/2000 | Trivedi et al. | 52/633 |
| 6,229,448 | B1 | * | 5/2001 | Bennett et al. | 340/618 |

FOREIGN PATENT DOCUMENTS

| | | | | |
|---|---|---|---|---|
| WO | WO 00/71464 | A1 | * 11/2000 | B67D/5/52 |

* cited by examiner

*Primary Examiner*—Gene Mancene
*Assistant Examiner*—Patrick Buechner
(74) *Attorney, Agent, or Firm*—Kaardal + Leonard, LLP

(57) ABSTRACT

A fluid dispensing system includes a housing surrounding a tank holding a vehicle fluid. A control assembly is housed in the housing and operationally coupled to a pump assembly for permitting dispensing of the vehicle fluid upon insertion of a pre-determined amount of currency into a currency collection assembly. Additional features include a cover member coupled to the housing using a spindle lock and a channel, a holster in the cover panel for holding a free end of a dispensing hose, free standing embodiment using a base, a main mounting bracket formed to accommodate coupling to existing surfaces, and a transmitter and associated hardware for monitoring fluid levels and usage from a remote location.

32 Claims, 16 Drawing Sheets

FLUID DISPENSING SYSTEM

BACKGROUND OF THE INVENTION

1. Field of the Invention

The present invention relates to currency operated fluid vending machines and more particularly pertains to a new fluid dispensing system for permitting the dispensation of vehicle fluids upon a user depositing money.

2. Description of the Prior Art

The use of currency operated fluid vending machines is known in the prior art. More specifically, currency operated fluid vending machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,967,366; U.S. Pat. No. 5,957,329; U.S. Pat. No. 5,018,645; U.S. Pat. No. 4,880,144; U.S. Pat. No. 3,318,732; U.S. Pat. No. 3,570,644; U.S. Pat. No. 5,497,914; U.S. Pat. No. 3,845,848; U.S. Pat. No. Des. 272,628; and U.S. Pat. No. Des. 273,790.

While these devices fulfill their respective, particular objectives and requirements, the aforementioned patents do not disclose a new fluid dispensing system. The inventive device includes a housing surrounding a tank holding a vehicle fluid. A control assembly is housed in the housing and operationally coupled to a pump assembly for permitting dispensing of the vehicle fluid upon insertion of a pre-determined amount of currency into a currency collection assembly. Additional features include a cover member coupled to the housing using a spindle lock and a channel, a holster in the cover panel for holding a free end of a dispensing hose, free standing embodiment using a base, a main mounting bracket formed to accommodate coupling to existing surfaces, and a transmitter and associated hardware for monitoring fluid levels and usage from a remote location.

In these respects, the fluid dispensing system according to the present invention substantially departs from the conventional concepts and designs of the prior art, and in so doing provides an apparatus primarily developed for the purpose of permitting the dispensation of vehicle fluids upon a user depositing money.

SUMMARY OF THE INVENTION

In view of the foregoing disadvantages inherent in the known types of currency operated fluid vending machines now present in the prior art, the present invention provides a new fluid dispensing system construction wherein the same can be utilized for permitting the dispensation of vehicle fluids upon a user depositing money.

The general purpose of the present invention, which will be described subsequently in greater detail, is to provide a new fluid dispensing system apparatus and method which has many of the advantages of the currency operated fluid vending machines mentioned heretofore and many novel features that result in a new fluid dispensing system which is not anticipated, rendered obvious, suggested, or even implied by any of the prior art currency operated fluid vending machines, either alone or in any combination thereof.

To attain this, the present invention generally comprises a housing surrounding a tank holding a vehicle fluid. A control assembly is housed in the housing and operationally coupled to a pump assembly for permitting dispensing of the vehicle fluid upon insertion of a pre-determined amount of currency into a currency collection assembly. Additional features include a cover member coupled to the housing using a spindle lock and a channel, a holster in the cover panel for holding a free end of a dispensing hose, free standing embodiment using a base, a main mounting bracket formed to accommodate coupling to existing surfaces, and a transmitter and associated hardware for monitoring fluid levels and usage from a remote location.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fluid dispensing system apparatus and method which has many of the advantages of the currency operated fluid vending machines mentioned heretofore and many novel features that result in a new fluid dispensing system which is not anticipated, rendered obvious, suggested, or even implied by any of the prior art currency operated fluid vending machines, either alone or in any combination thereof.

It is another object of the present invention to provide a new fluid dispensing system which may be easily and efficiently manufactured and marketed.

It is a further object of the present invention to provide a new fluid dispensing system which is of a durable and reliable construction.

An even further object of the present invention is to provide a new fluid dispensing system which is susceptible of a low cost of manufacture with regard to both materials and labor, and which accordingly is then susceptible of low prices of sale to the consuming public, thereby making such fluid dispensing system economically available to the buying public.

Still yet another object of the present invention is to provide a new fluid dispensing system which provides in the apparatuses and methods of the prior art some of the advantages thereof, while simultaneously overcoming some of the disadvantages normally associated therewith.

Still another object of the present invention is to provide a new fluid dispensing system for permitting the dispensation of vehicle fluids upon a user depositing money.

Yet another object of the present invention is to provide a new fluid dispensing system which includes a housing either surrounding or defining a tank holding a vehicle fluid. A control assembly is housed in the housing and operationally coupled to a pump assembly for permitting dispensing of the vehicle fluid upon insertion of a pre-determined amount of currency into a currency collection assembly. Additional features include a cover member coupled to the housing using a spindle lock and a channel, a holster in the cover panel for holding a free end of a dispensing hose, free standing embodiment using an integral base, a main mounting bracket formed to accommodate coupling to existing surfaces, and a transmitter and associated hardware for monitoring fluid levels and usage either from within the unit or from a remote location.

Still yet another object of the present invention is to provide a new fluid dispensing system that provides a way of dispensing vehicle fluids to user upon the deposit of money.

Even still another object of the present invention is to provide a new fluid dispensing system that provides high capacity storage of vehicle fluids for dispensation by the user.

Still yet even another object of the present invention is to provide a publicly accessible and viewable unit which may incorporate advertising space on an exterior of the housing or tank.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
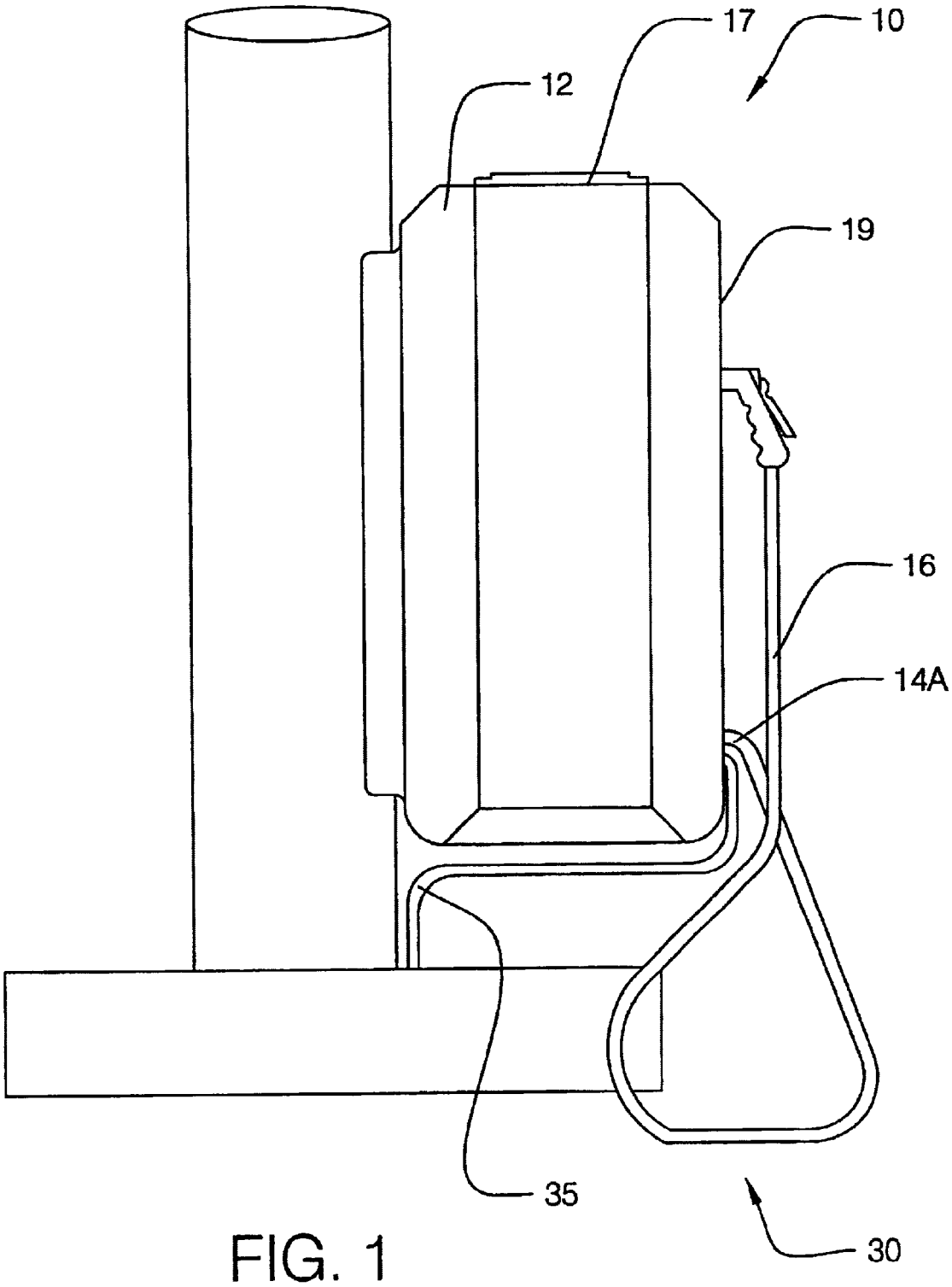
FIG. 1 is a side view of a new fluid dispensing system according to the present invention mounted to a pillar.
Figure 2:
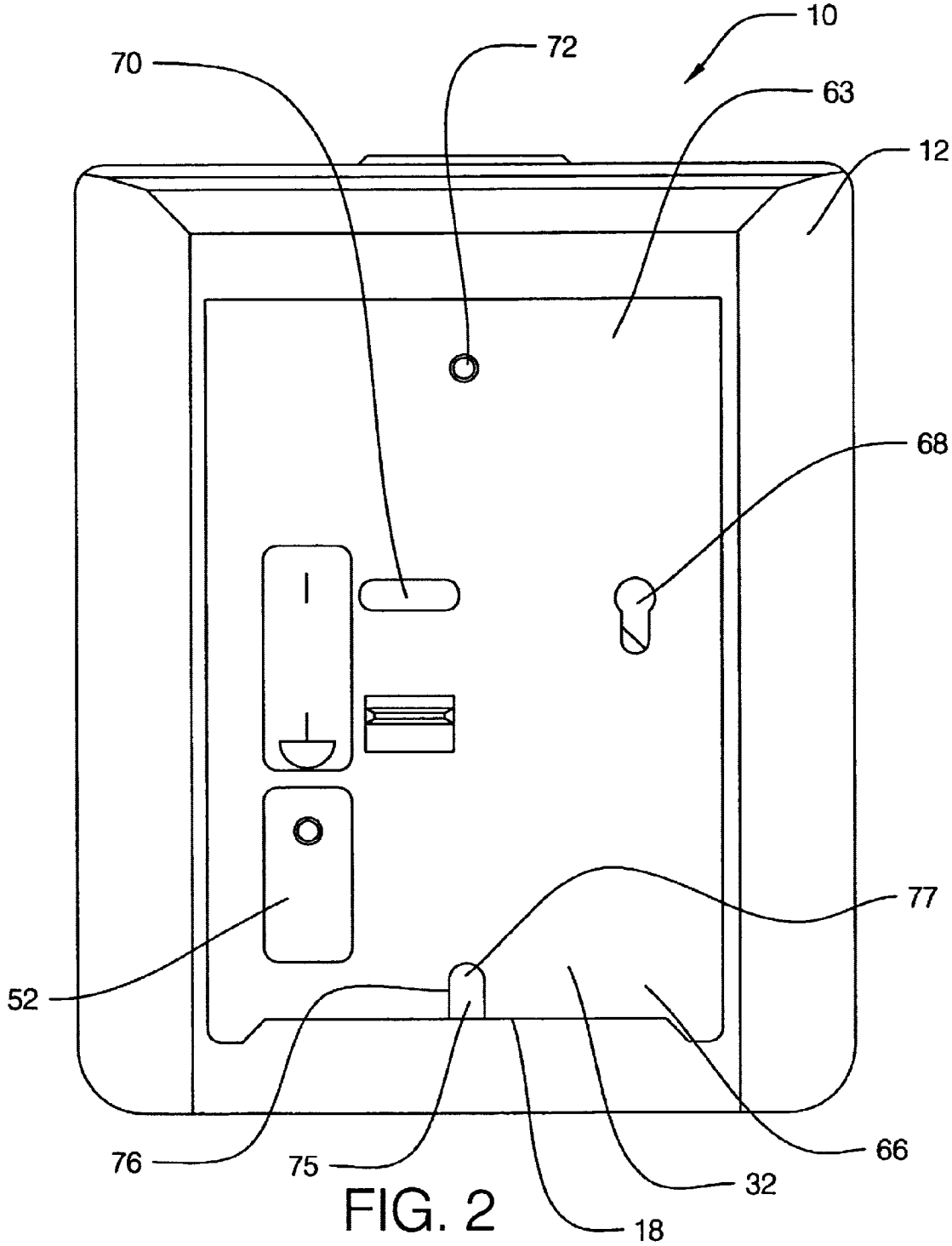
FIG. 2 is a front view of the present invention with the cover member in an open position.
Figure 3:
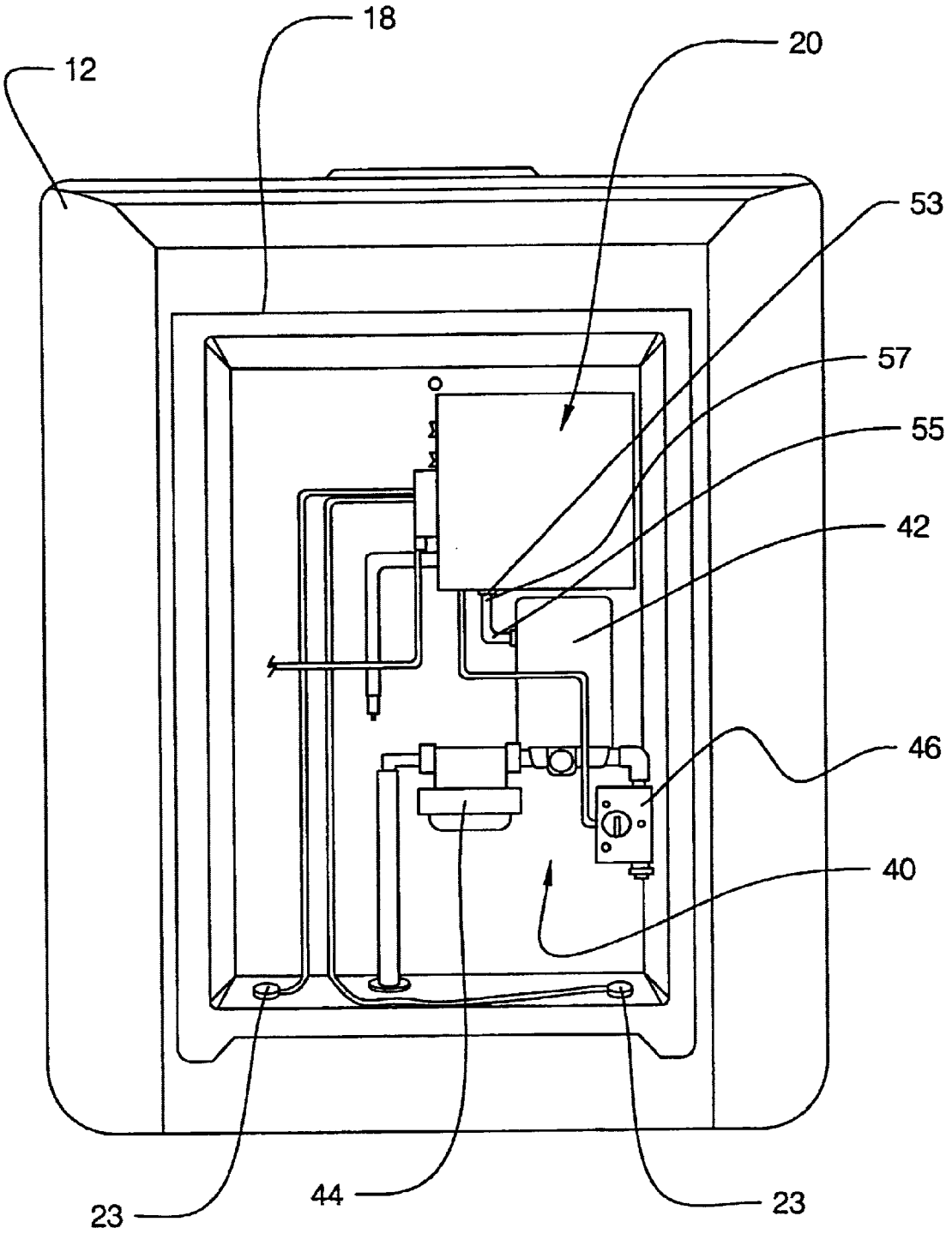
FIG. 3 is a front view of the present invention with the cover member removed.

With reference now to the drawings, and in particular to FIGS. 1 through 17 thereof, a new fluid dispensing system embodying the principles and concepts of the present invention and generally designated by the reference numeral 10 will be described.

As best illustrated in FIGS. 1 through 17, the fluid dispensing system 10 generally comprises a housing 12; a tank 14 for holding a vehicle fluid 2 such as windshield washing fluid, hydraulic brake fluid, antifreeze, soap solutions, or power steering fluid; a dispensing hose 16; and a control assembly 20. The dispensing system 10 is designed for permitting desired automatic dispensing of the vehicle fluid at a desired location of a fuel filling station. The vehicle solutions could also be any other known fluids typically used in association with automotive, farm or aviation vehicles.

The tank 14 is positioned in the housing and has an interior space designed for holding the vehicle fluid 2. The housing 12 is structured to have an opening 18 in a forward face 19 of the housing 12.

The dispensing hose 16 is part of a dispensing hose assembly 30 that is coupled to the tank 14. The dispensing hose 16 has a first end 14A in environmental communication with the interior space of the tank 14. Thus, the dispensing hose 16 is designed for dispensing the vehicle fluid 2 through the dispensing hose 16.

A pump assembly 40 includes a pump 42 and is coupled to the dispensing hose 16 for pumping the vehicle fluid 2 through the dispensing hose 16. The pump assembly 40 includes a filter 44 positioned between the tank 14 and the pump 42 for removing debris from the vehicle fluid 2. Thus, the filter 44 removes debris from the vehicle fluid 2 before the vehicle fluid 2 enters the pump 42. In an embodiment, the pump assembly 40 also includes a flow meter 46 for monitoring flow of the vehicle fluid 2 through the pump assembly 40.

The control assembly 20 is operationally coupled to the pump assembly 40 for selectively activating the pump 42. Thus, the pump 42 dispenses the vehicle fluid 2 only upon activation by the control assembly 20.

A cover member 32 is couplable to the housing 12 for covering the opening 18 in the forward face 19 such that the control assembly 20 is covered to prevent unauthorized access to the control assembly 20. A currency collection assembly 50 is operationally coupled to the control assembly 20 such that the control assembly 20 dispenses the vehicle fluid only upon reception of a pre-determined initial value of currency collected by the currency collection assembly 50. Preferably, the currency collected can be in the form of either bills or coins. It is further considered that for purposes of this application that currency includes tokens should a token system be employed to activate the system 10. Such token systems are well known and commonly employed at golf driving ranges for the purchase of range balls. An additional alternative is use of a pre-paid card system or debit card system using conventional methods for obtaining, utilizing, and replenishing pre-paid credit that may be used to obtain vehicle fluid. It is also contemplated that such a card or credit system could utilize a magnetic strip incorporated into a key fob.

The currency collection assembly 50 includes a currency collection bin 52 coupled to the cover member 32. The currency collection bin 52 is positionable beneath a main portion 54 of the currency collection assembly 50 when the cover member 32 is engaged to the housing. Thus, currency passing through the main portion 54 of the currency collection assembly 50 is collected in the currency collection bin 52.

In a most preferred embodiment, the control assembly 20 utilizes a computer controller 59 for crediting a pre-determined number of pulses upon accumulation of a pre-determined amount of currency. Each pulse is associated with a given amount of fluid such that a desired amount of fluid can be purchased by insertion of sufficient currency. As an additional feature, the computer controller 59 is operationally coupled to the currency collection assembly to prevent acceptance of currency when the level of fluid in the tank is below a pre-determined level, thus preventing acceptance of money in excess of an amount available to be dispensed.

Alternately, the control assembly 20 may include an accumulating timer 56 for permitting dispensing of the vehicle fluid 2 for a pre-determined period of time upon reception of the initial value of currency collected by the currency collection assembly 50. In an embodiment, the currency collection assembly 50 is operationally coupled to the control assembly 20 such that the vehicle fluid 2 is dispensable for an additional pre-determined period of time upon reception of additional currency in excess of the initial value of currency collected by the currency collection assembly 50.

The opening 18 in the housing 12 has a channel 62 extending along a bottom 64 of the opening 18 for receiving a bottom 66 of the cover member 32.

In an embodiment, the cover member 32 includes a holster portion 68 for receiving a free end of the dispensing hose 16. Typically, the free end of the dispensing hose 16 will have a pistol style attachment or other comparable nozzle with a trigger mechanism to permit a user to regulate flow of the vehicle fluid 2 through the dispensing hose 16. A holster switch 65 is coupled to the cover member 32 and is operationally coupled to the control assembly 20 for preventing dispensing of the vehicle fluid 2 upon return of the free end of the dispensing hose 16 to the holster portion 68 after use. This may be by zeroing the credited pulses when the computer controller 59 is used or by zeroing an amount of time on the accumulating timer 56.

A display panel 70 is coupled to the cover member 32 and is operationally coupled to the control assembly 20 for displaying either remaining amount of fluid dispensable or remaining time for dispensing the vehicle fluid 2.

A spindle lock 72 is coupled to the cover member 32 proximate a top 63 of the cover member 32. The spindle lock 72 has a threaded interior end portion 73 selectively engageable to a brass socket 82 coupled to an interior wall 74 of the housing 12 for locking the cover member 32 to the housing 12. In use, the spindle lock 72 secures the top portion of the cover member 32 while the bottom 66 of the cover member 32 is held within the channel 62 to prevent the cover member 32 from being removed.

In an embodiment, the cover member 32 has orthogonal side portions 60 for seating in a recessed lip 61 of the housing 12 to prevent prying of the cover member 32 from the housing 12 when the cover member 32 is secured to the housing 12. The orthogonal side portions 60 can be provided by bending edges of the cover member 32 forwardly to a 90 degree angle with respect to an interior portion of the cover member 32.

In an embodiment, the channel 62 in the opening 18 of the housing 12 has a protrusion 75. The bottom 66 of the cover member 32 has a notch 76 for receiving the protrusion 75 when the cover member 32 is coupled to the housing 12. The notch 76 extends upwardly into the cover member 32 such that an upper portion 77 of the notch 76 receives the dispensing hose 16 therethrough when the cover member 32 is coupled to the housing 12.

In an embodiment, a transmitter 78 is operationally coupled to the control assembly 20 for transmitting status data to a remote location for monitoring use of the fluid dispensing system 10.

A tank fluid level sensor 23 is coupled to the tank 14 for monitoring a level of the vehicle fluid 2 in the tank 14. The tank level sensor 23 is operationally coupled to the control assembly 20 such that the transmitter 78 transmits a refilling signal to the remote location upon detection of a pre-determined level of fluid in the tank 14.

The tank 14 has a fill opening 15 positioned on a top surface 17 of the tank 14. A perimeter edge of the fill opening 15 is molded to engage a cap member 25 that is selectively engageable to the fill opening 15 for covering the fill opening 15. In an embodiment, the cap member 25 has a locking mechanism 27 for preventing removal of the cap member 25 for facilitating access to the tank 14 only by authorized persons for maintenance of the fluid dispensing system 10.

Figure 4:
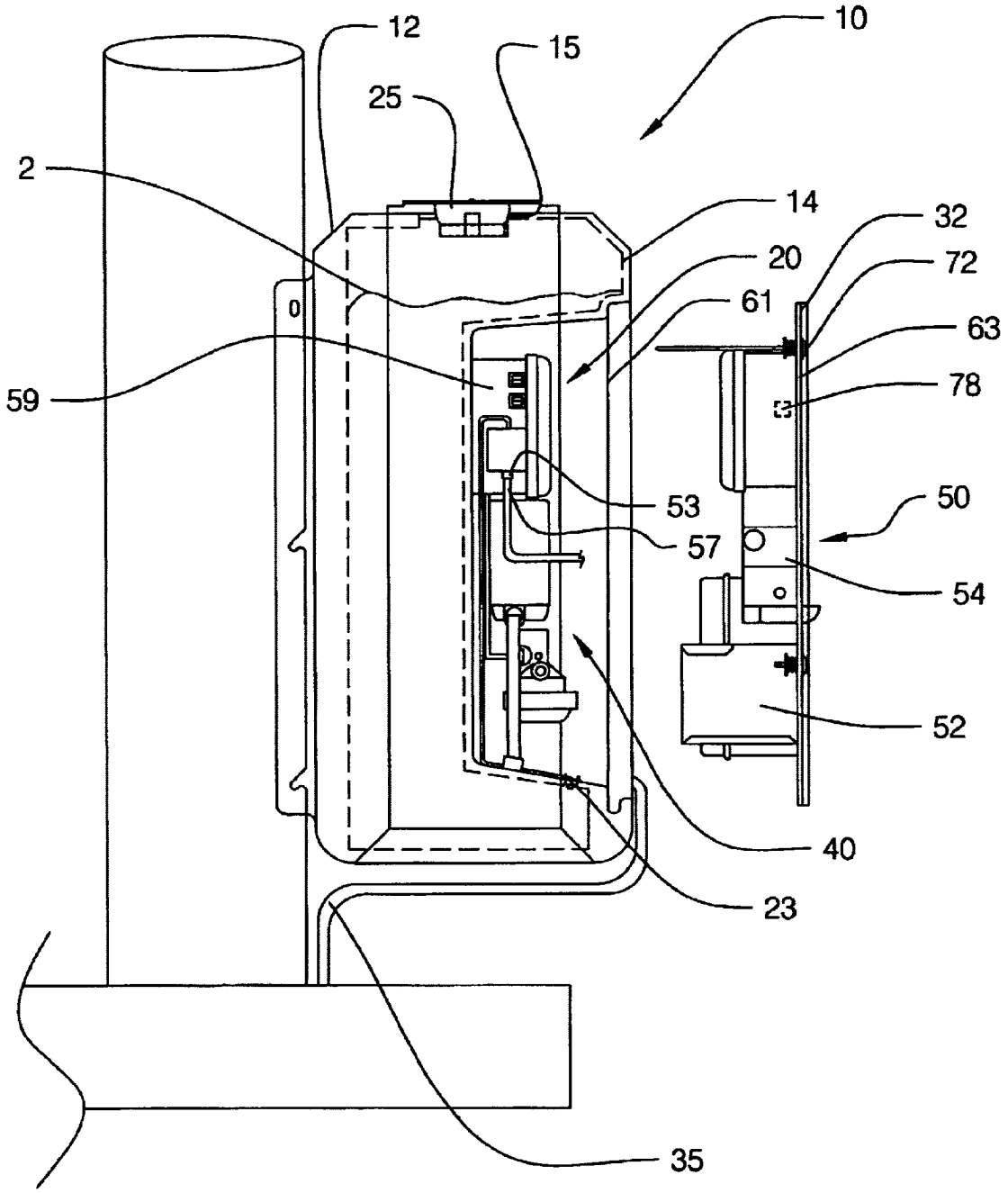
FIG. 4 is a side exploded view of the present invention mounted to a pillar.
Figure 5:
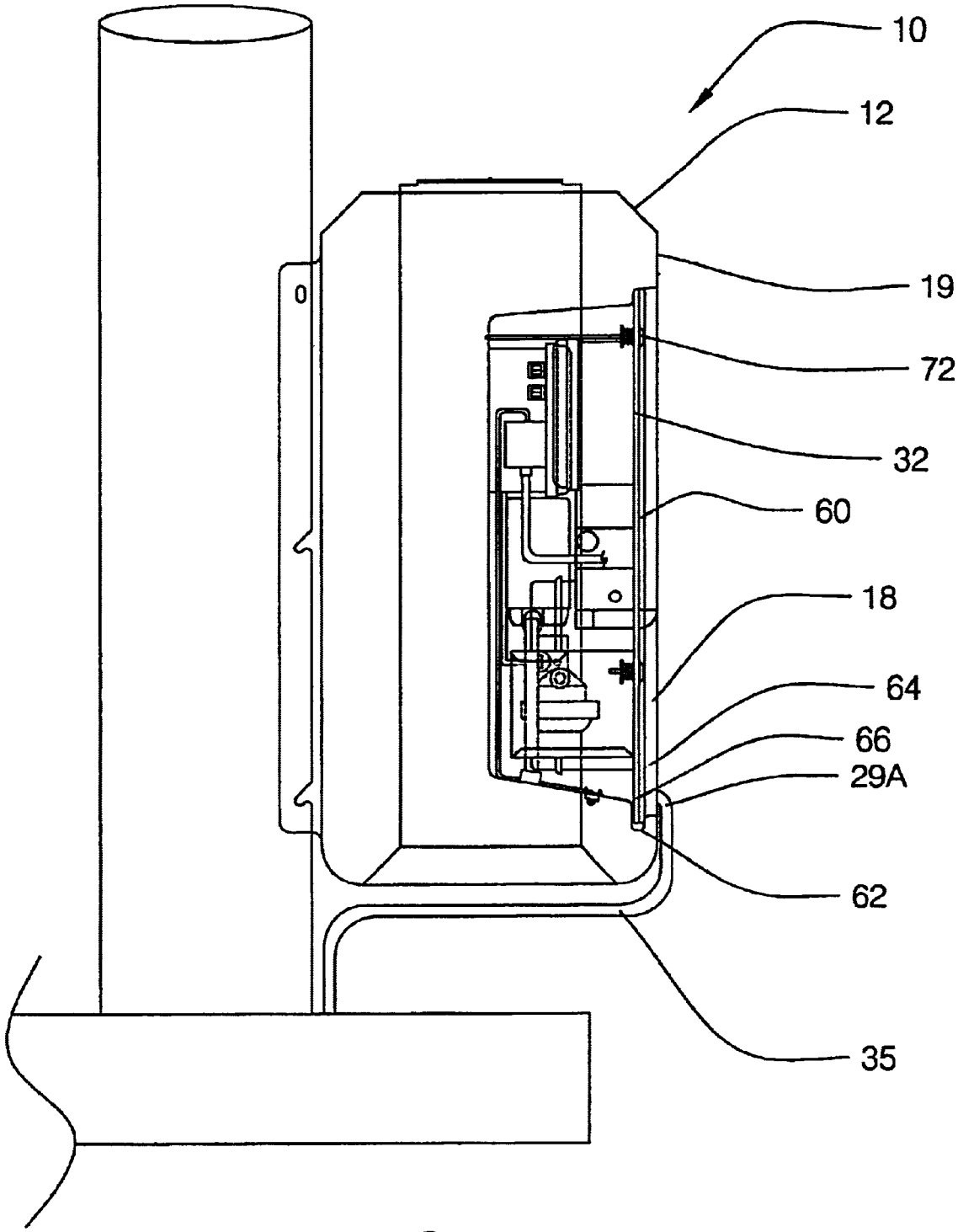
FIG. 5 is a cross-sectional view of the present invention.
Figure 6:
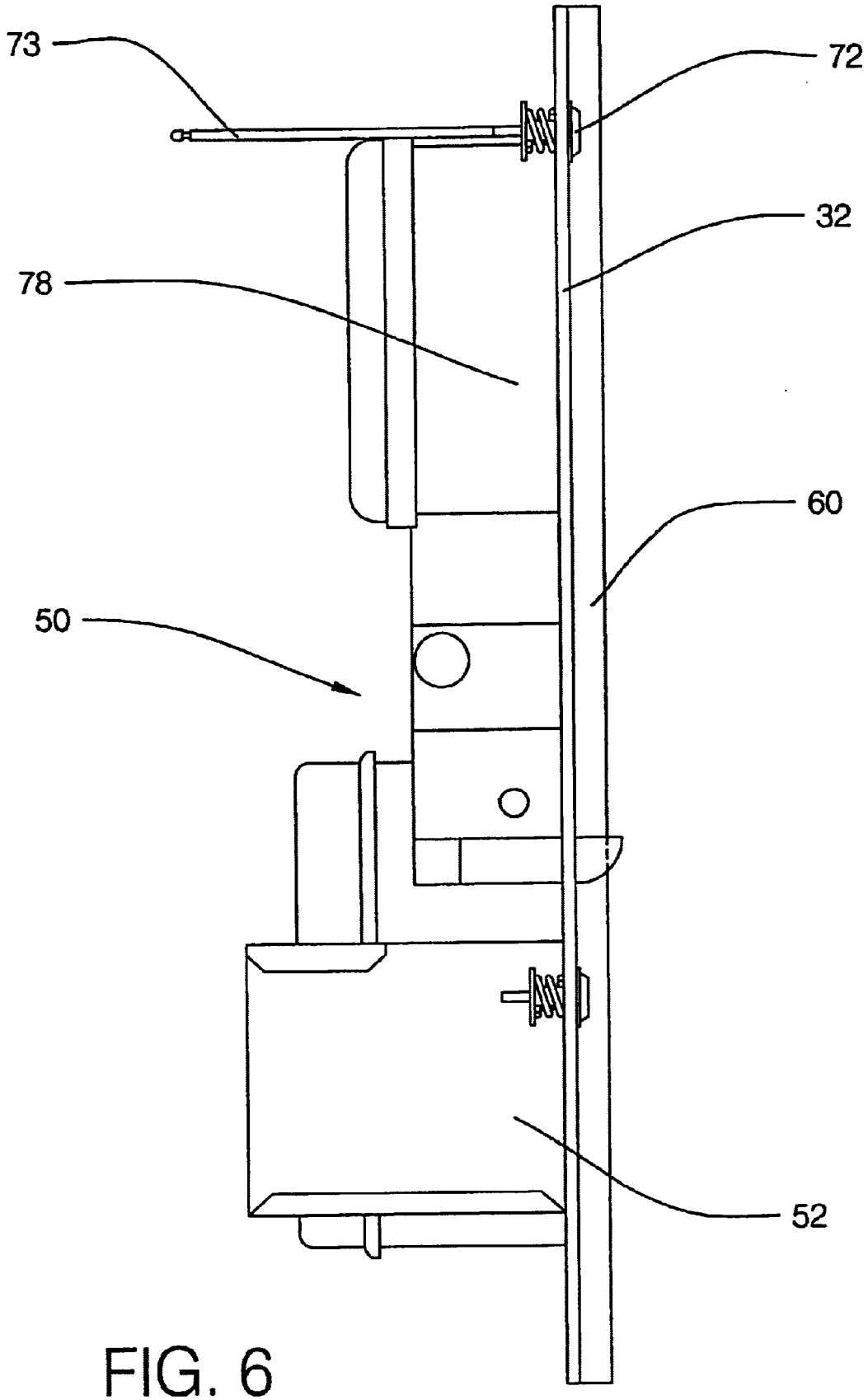
FIG. 6 is an enlarged side view of the cover member of the present invention.
Figure 7:
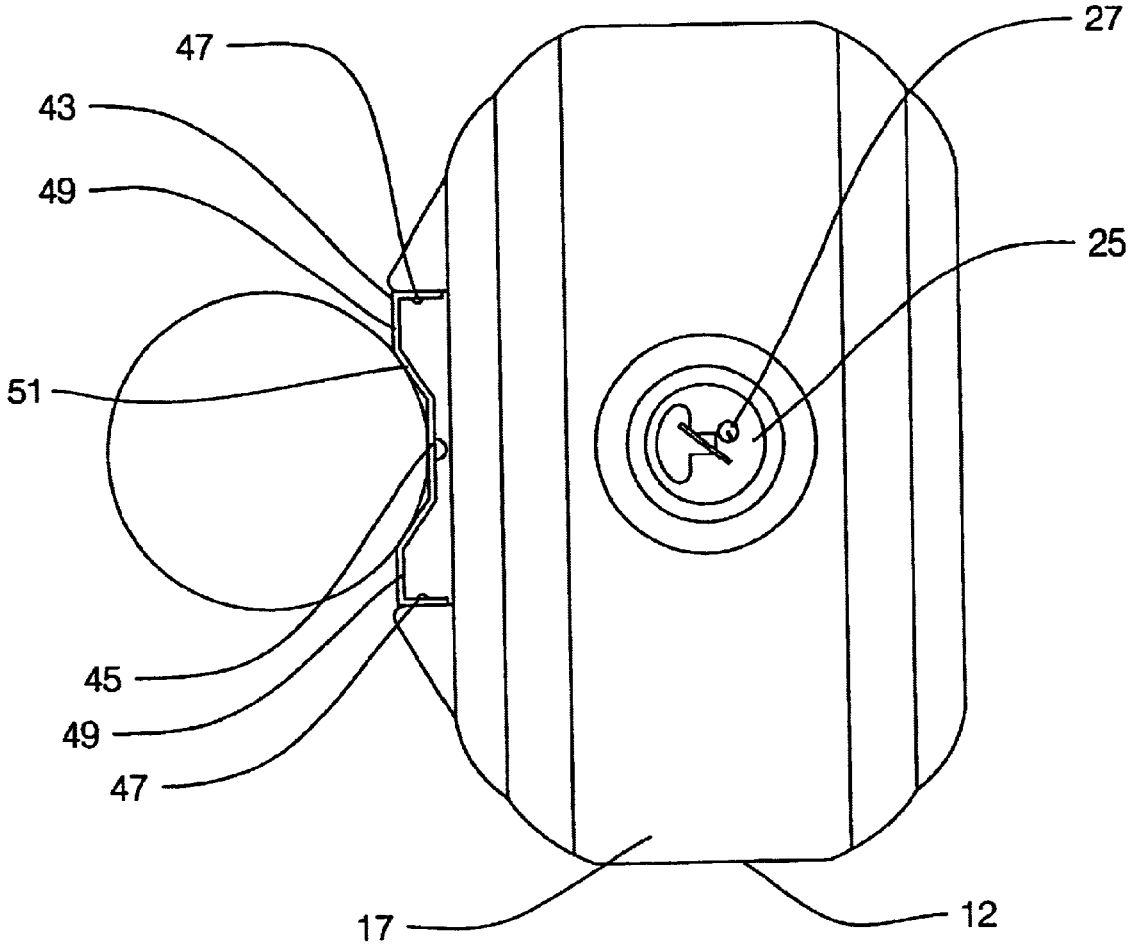
FIG. 7 is a top view of the present invention mounted to a pillar.
Figure 8:
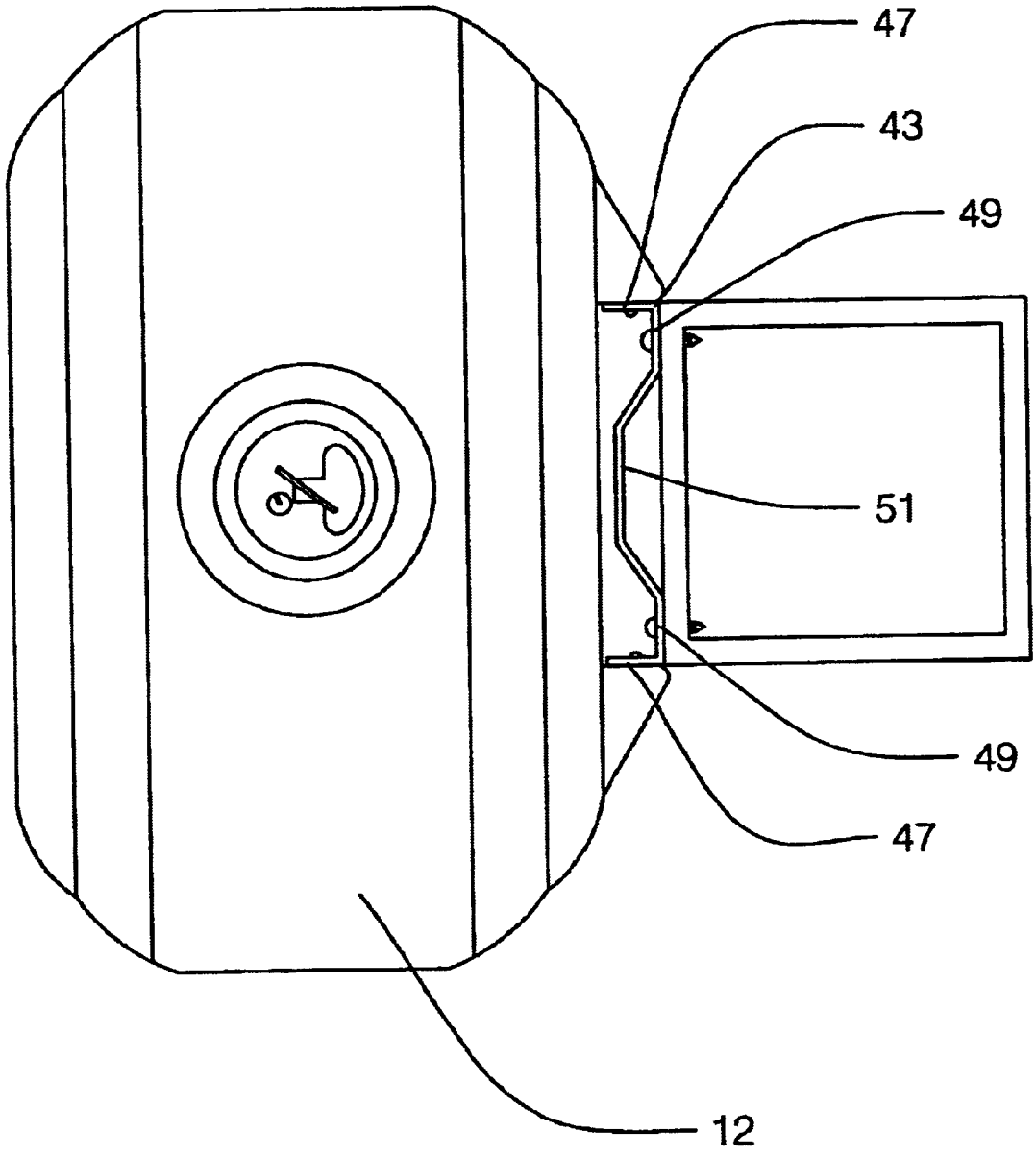
FIG. 8 is a top view of the present invention mounted to an alternate pillar.
Figure 9:
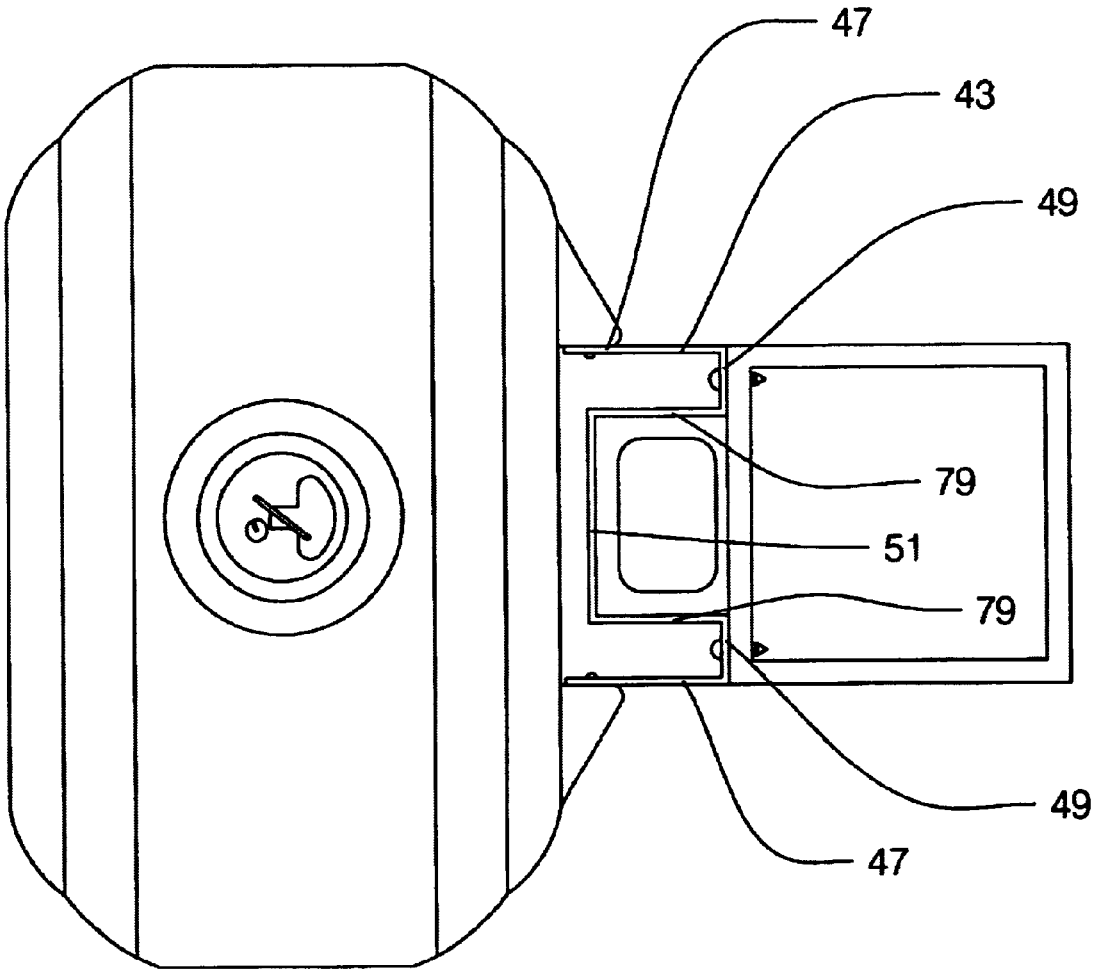
FIG. 9 is a top view of alternate embodiment of the mounting bracket of the present invention mounted to a pillar.
Figure 10:
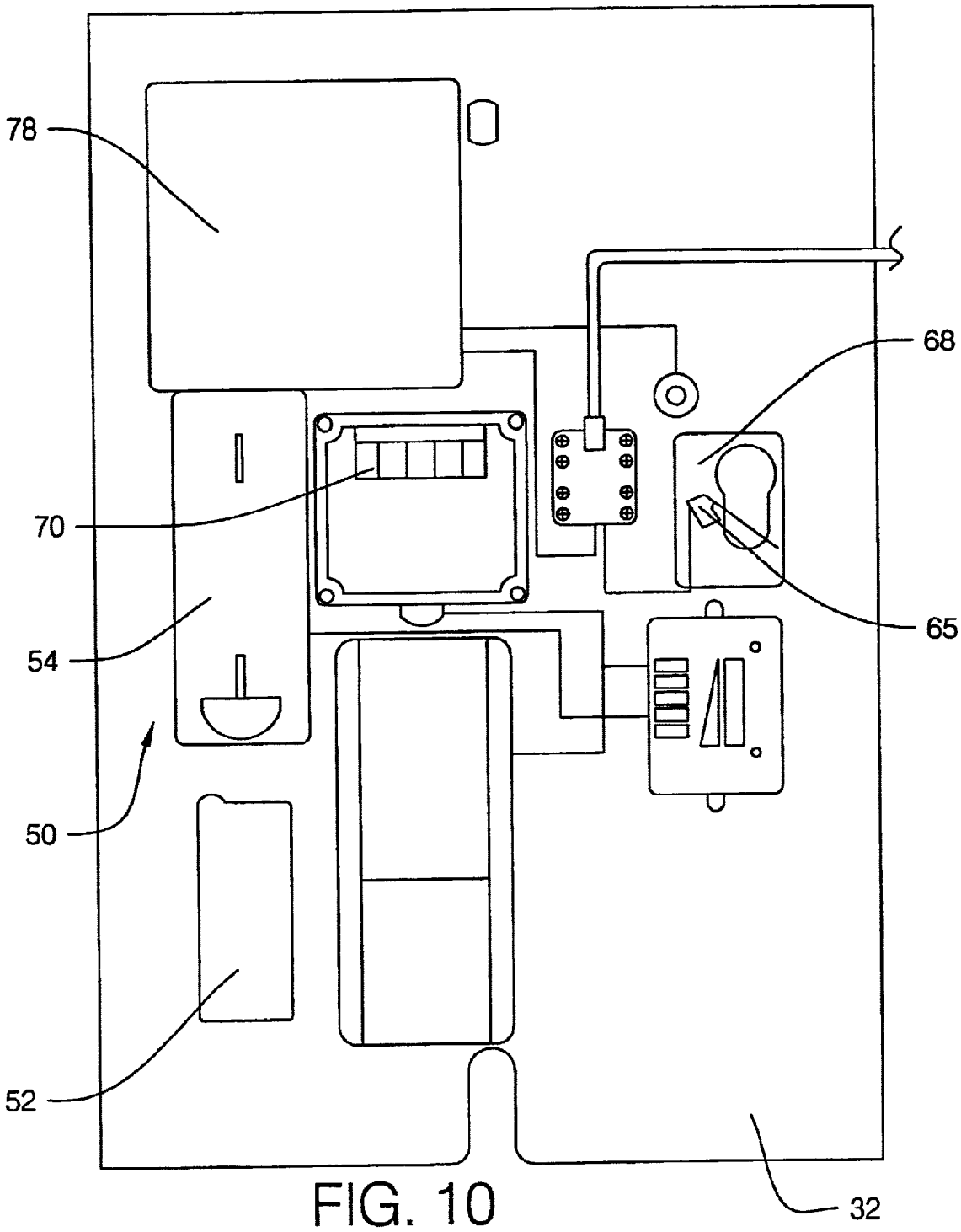
FIG. 10 is a schematic view of the cover member of the present invention.
Figure 11:
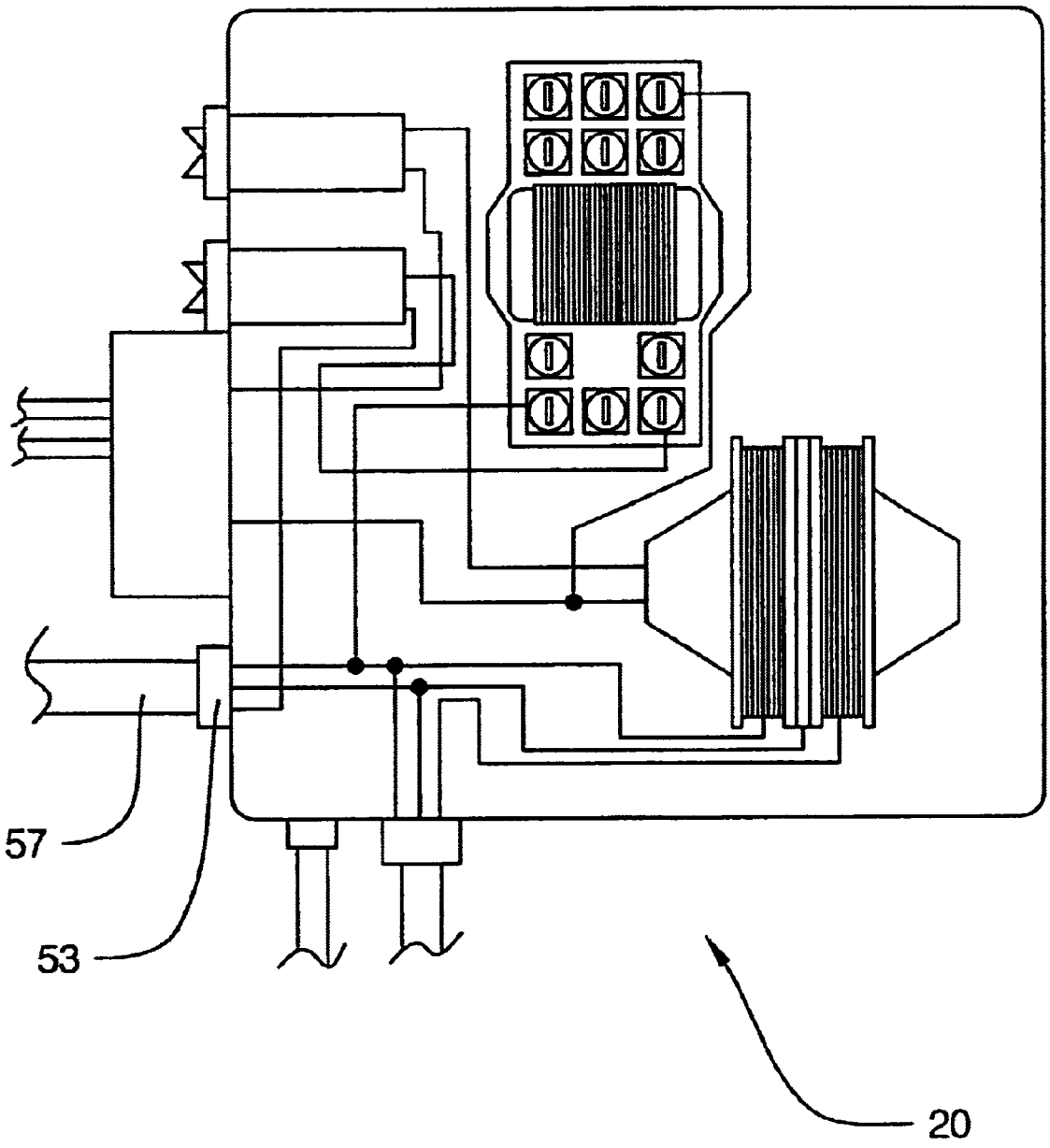
FIG. 11 is a schematic view of the control assembly of the present invention.
Figure 12:
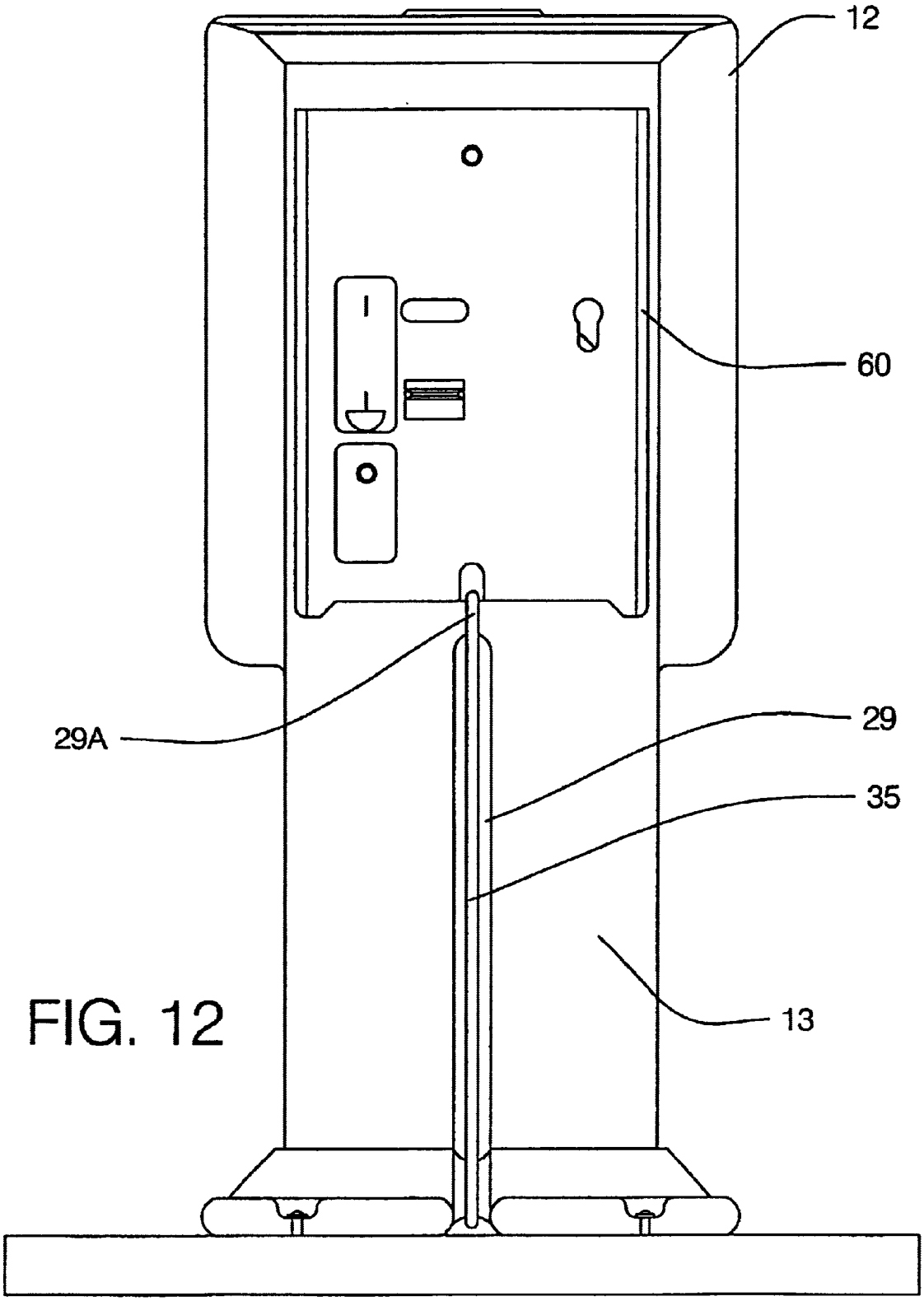
FIG. 12 is a front view of an alternate embodiment of the present invention.
Figure 13:
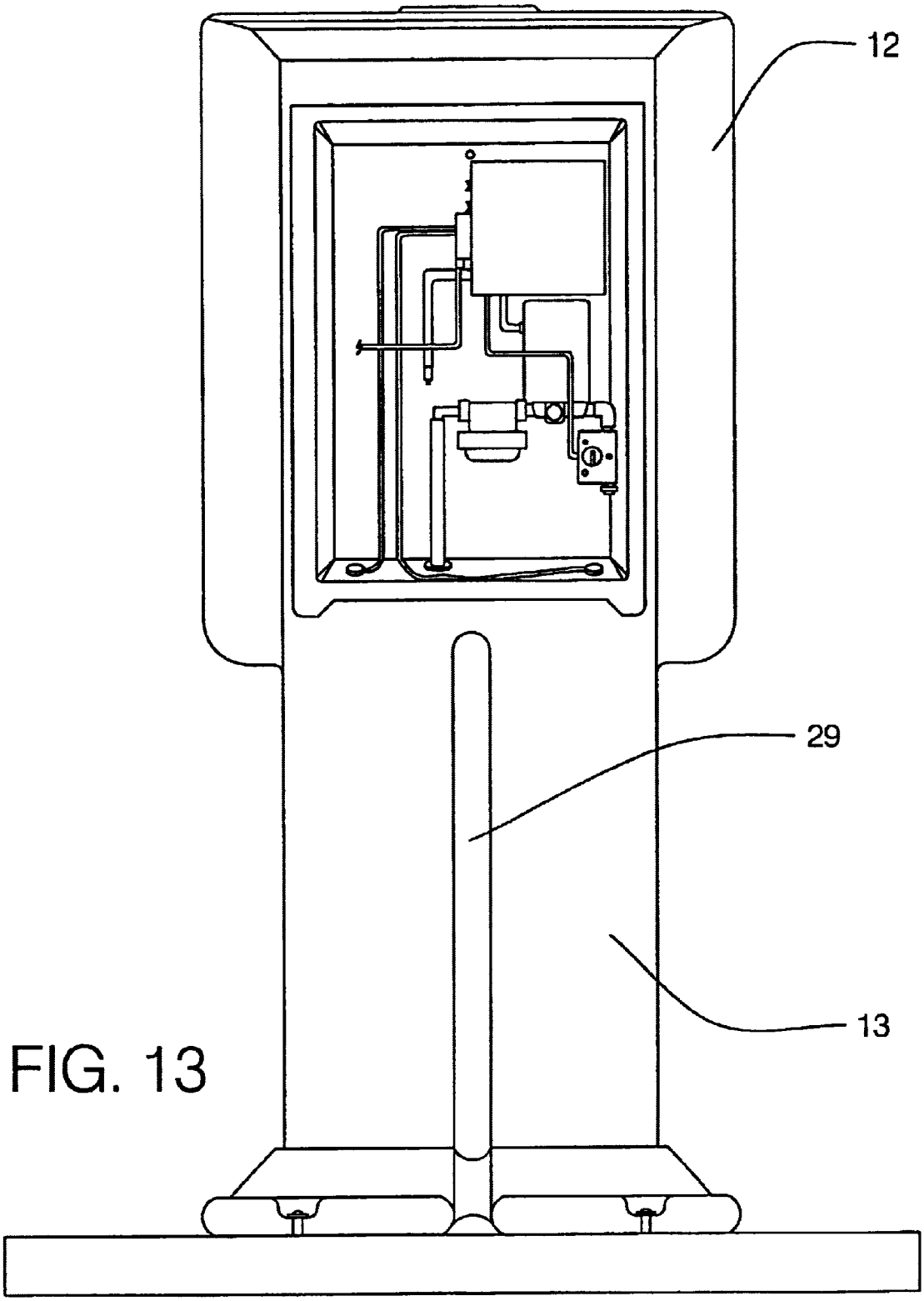
FIG. 13 is a front view of an alternate embodiment of the present invention with the cover member removed.
Figure 14:
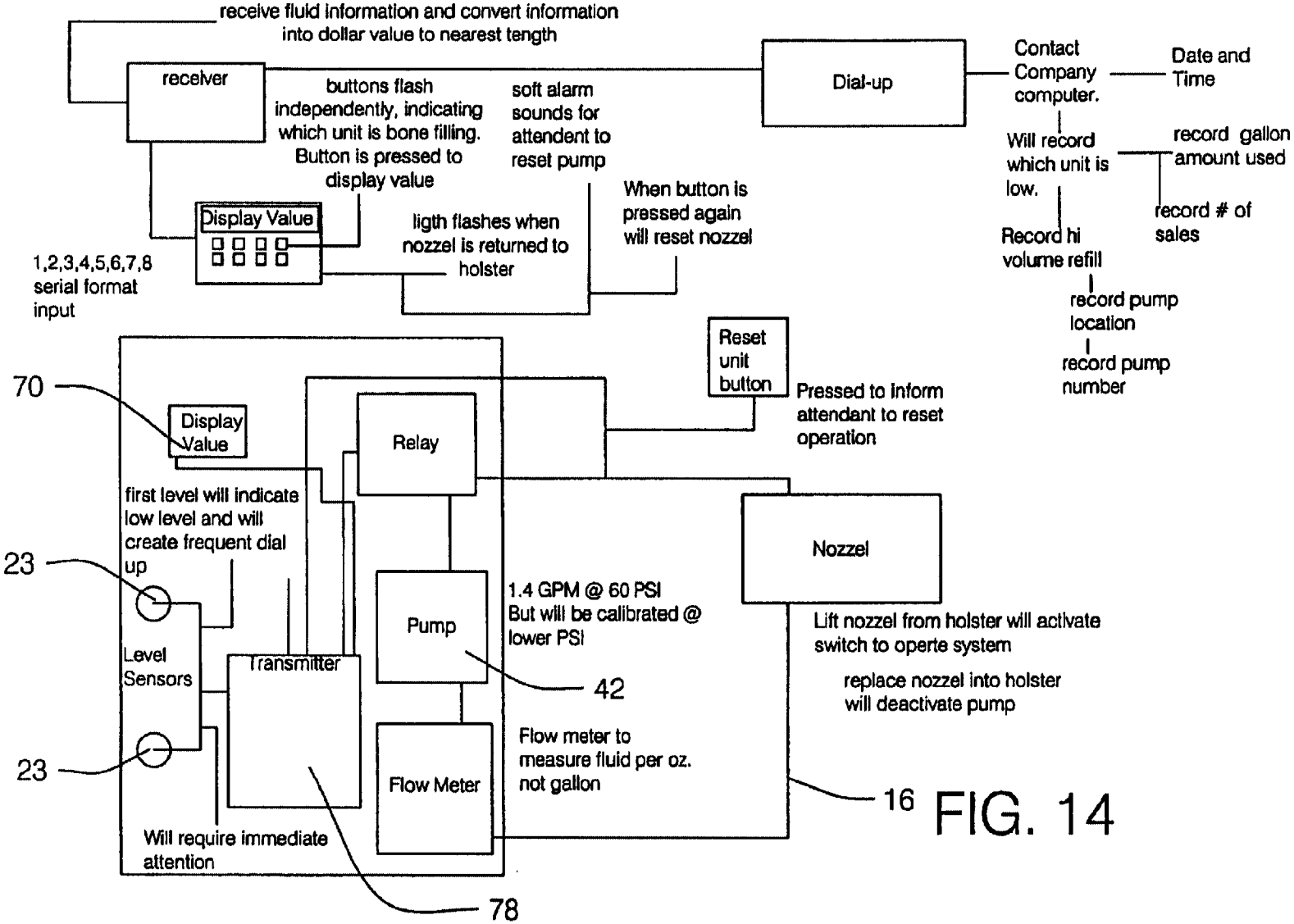
FIG. 14 is a schematic view of the operation of the present invention.
Figure 15:
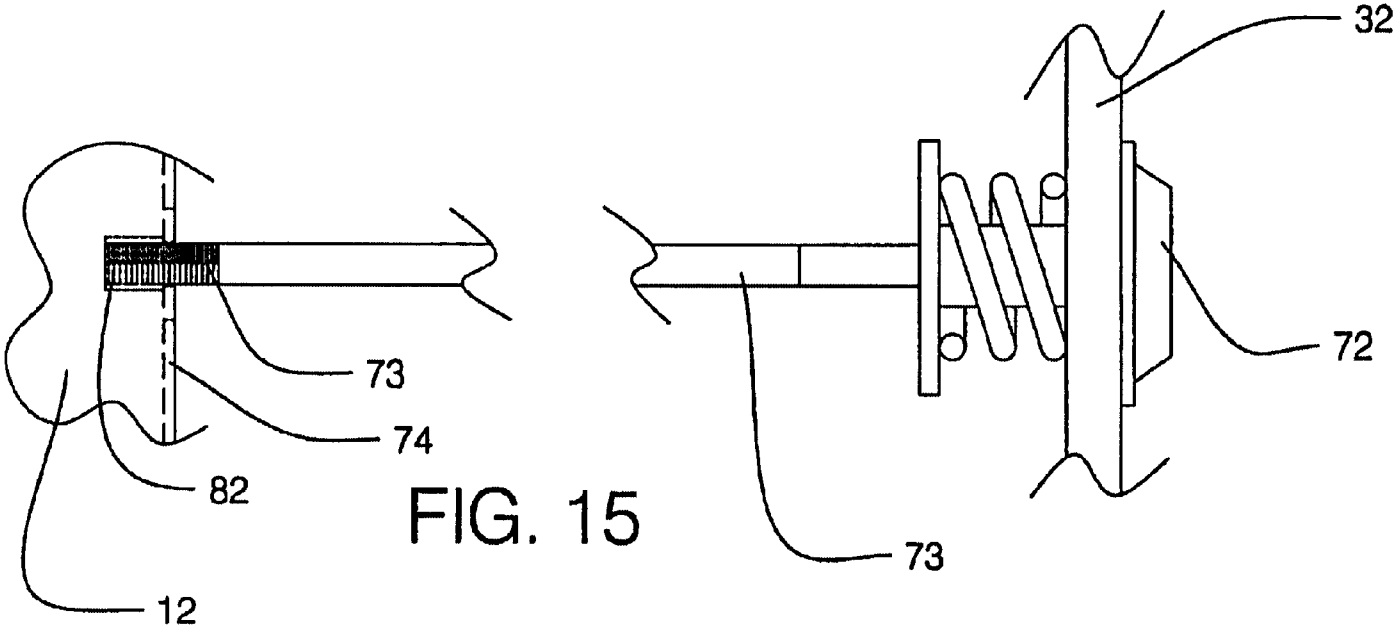
FIG. 15 is an enlarge view of the spindle lock of the present invention.
Figure 16:
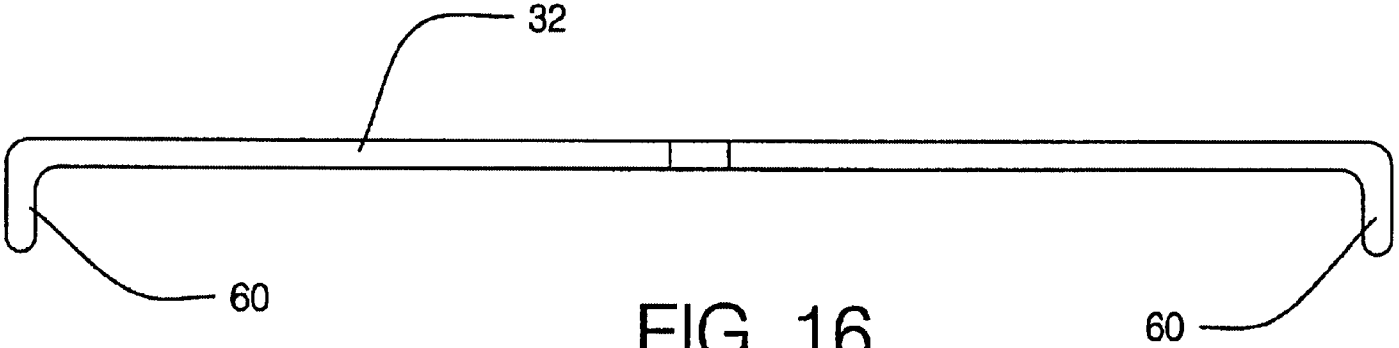
FIG. 16 is a top view of the cover member of the present invention.
Figure 17:
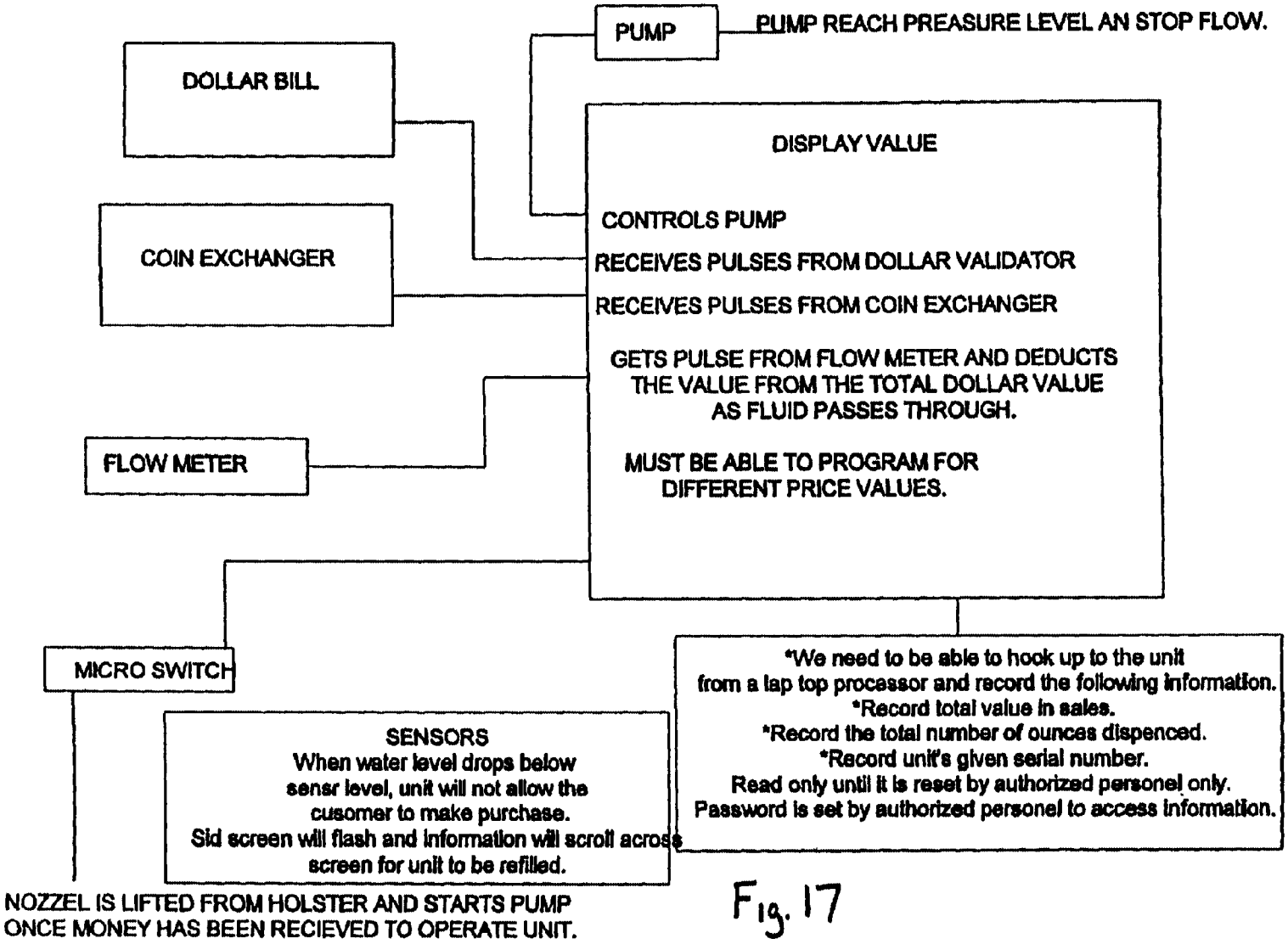
FIG. 17 is a schematic view of an alternative process of the operation of the present invention.

In an embodiment, the control assembly 20 includes an electronic connection port 53. A wire 55 is coupled between the pump assembly 40 and the control assembly 20. Thus, the pump 42 is activatable by the control assembly 20. The wire 55 has a first end 57 removably insertable into the electronic connection port 53 for facilitating replacement of the control assembly 20 in the event the control assembly 20 breaks down. Most preferably parts as shown in FIG. 4 are coupled to the cover member 32 to permit replacement these parts as a single unit to facilitate replacement of these parts. Typically, other parts or combinations of parts may also be coupled to the cover member to permit easy replacement.

In a free standing embodiment, a base portion 13 is integrally coupled to the housing 12 for supporting the housing 12 above a surface on which the base portion 13 rests. The base portion 13 includes a channeled rib 29 extends upward from a bottom of the base portion 13. An electrical wire conduit 35 for enclosing electrical wiring is positioned substantially within the channeled rib 29 and has an upper end 29A extending into the housing 12. The base portion 13 may also be an integral portion of the tank to provide additional fluid holding capacity.

In an embodiment attachable to an existing support surface, a main mounting bracket 43 is designed for coupling to the existing surface. The housing 12 is coupled to the main mounting bracket 43. The main mounting bracket 43 includes a medial portion 45 designed for coupling to an outer surface of a structure. The main mounting bracket 43 further includes a pair of outer portions 47 extending from the medial portion 45. The outer portions 47 are coupled to the housing 12.

In an embodiment, the medial portion 45 of the main mounting bracket 43 includes a pair of planar outside portions 49 and a recessed central portion 51 between the planar outside portions 49. The central recessed portion 51 includes a pair of spaced vertical parallel structure bracket walls 79 extending from the planar outside portions 49. Thus, the central recessed portion 51 is designed for receiving a generally rectangular shaped structure. In an another embodiment, the recessed central portion 51 has an arcuate curvature. Thus, the central recessed portion 51 is designed for receiving a generally arcuately shaped outer face of the structure.

Although a spray can be provided, a flow restrictor or other conventional means may be provided to limit the flow of fluid through the dispensing hose to prevent overspray or other misuse resulting from forceful spraying of the vehicle fluid.

In use, the user inserts currency into the currency collection assembly which activates the timer for a time remaining or the computer controller for a number of pulses associated with an amount of vehicle fluid. The time remaining or amount remaining is displayed so that the user is aware of amount of time or fluid left for dispensing. The control assembly also activates the pump assembly upon the insertion of currency. The user then uses the dispensing hose to dispense the vehicle fluid, for example filling the windshield washer fluid reservoir. The user can then add more currency to the currency collection assembly for additional time or replace the dispensing hose in the holster portion of the cover member, thus deactivating the system.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fluid dispensing system comprising:

a housing;

a tank positioned in said housing, said tank having an interior space adapted for holding a vehicle fluid;

said housing being structured to have an opening in a forward face of said housing;

a dispensing hose assembly coupled to said tank, said dispensing hose assembly including a dispensing hose having a first end in environmental communication with said interior space of said tank whereby said dispensing hose is adapted for dispensing the vehicle fluid through said dispensing hose;

a pump assembly coupled to said dispensing hose for pumping the vehicle fluid through said dispensing hose;

a control assembly operationally coupled to said pump assembly for selectively activating said pump whereby said pump dispenses the vehicle fluid only upon activation by said control assembly;

a cover member couplable to said housing for covering said opening in said forward face such that said control assembly is covered; and said opening in said housing having a channel extending along a bottom of said opening for receiving a bottom of said cover member.

2. The fluid dispensing system of claim 1 further comprising:

a display panel coupled to said cover member, said display panel being operationally coupled to said control assembly for displaying a remaining time for dispensing said vehicle fluid.

3. The fluid dispensing system of claim 1, further comprising:

a spindle lock coupled to said cover member proximate a top of said cover member, said spindle lock having an interior end portion selectively engageable to a socket fixedly coupled to an interior wall of said housing for locking said cover member to said housing.

4. The fluid dispensing system of claim 1, further comprising:

said pump assembly including a pump;

said pump assembly including a filter for removing debris from said vehicle fluid, said filter being positioned between said tank and said pump whereby said filter removes debris from said vehicle fluid before said vehicle fluid enters said pump.

5. The fluid dispensing system of claim 1, further comprising:

said pump assembly including a flow meter for monitoring flow through said pump assembly.

6. The fluid dispensing system of claim 1, further comprising:

said control assembly including an electronic connection port; and a wire coupled between said pump assembly and said control assembly whereby said pump is activatable by said control assembly, said wire having a first end removably insertable into said electronic connection port for facilitating replacement of said control assembly.

7. The fluid dispensing system of claim 1, further comprising:

a base portion coupled to said housing for supporting said housing above a surface on which said base portion rests;

said base portion being integrally coupled to said housing; and said tank extending into said base portion.

8. The fluid dispensing system of claim 1, further comprising:

said channel in said opening of said housing having a protrusion;

said bottom of said cover member having a notch for receiving said protrusion when said cover member is coupled to said housing.

9. The fluid dispensing system of claim 1, further comprising:

a transmitter operationally coupled to said control assembly for transmitting status data to a remote location for monitoring use of said fluid dispensing system.

10. The fluid dispensing system of claim 9, further comprising:

a tank fluid level sensor coupled to said tank for monitoring a level of said vehicle fluid in said tank, said tank level sensor being operationally coupled to said control assembly such that said transmitter transmits a refilling signal to said remote location upon detection of a pre-determined level of fluid in said tank.

11. The fluid dispensing system of claim 1, further comprising:

said cover member including a holster portion for receiving a free end of said dispensing hose.

12. The fluid dispensing system of claim 11, further comprising:

a holster switch coupled to said cover member, said holster switch being operationally coupled to said control assembly for preventing dispensing of said vehicle fluid upon return of said free end of said dispensing hose to said holster portion after use.

13. The fluid dispensing system of claim 1, further comprising:

a main mounting bracket adapted for coupling to a surface, said housing being coupled to said main mounting bracket.

14. The fluid dispensing system of claim 13 wherein said main mounting bracket includes a medial portion adapted for coupling to an outer surface of a structure, said main mounting bracket further including a pair of outer portions extending from said medial portion, said outer portions being coupled to said housing.

15. The fluid dispensing system of claim 14 wherein said medial portion of said main mounting bracket includes a pair of planar outside portions and a recessed central portion between said planar outside portions.

16. The fluid dispensing system of claim 15, further comprising:

said central recessed portion including a pair of spaced vertical parallel structure bracket walls extending said planar outside portions whereby said central recessed portion is adapted for receiving a generally rectangular shaped structure.

17. The fluid dispensing system of claim 16, further comprising:

said central recessed portion having an arcuate curvature whereby said central recessed portion is adapted for receiving a generally arcuately shaped outer face of said structure.

18. The fluid dispensing system of claim 1, further comprising:

a currency collection assembly operationally coupled to said control assembly whereby said control assembly dispenses said vehicle fluid only upon reception of a pre-determined initial value of currency collected by said currency collection assembly.

19. The fluid dispensing system of claim 18, further comprising:

said currency collection assembly including a currency collection bin coupled to said cover member, said currency collection bin being positionable beneath a main portion of said currency collection assembly when said cover member is engaged to said housing whereby currency passing through said main portion of said currency collection assembly is collected in said currency collection bin.

20. The fluid dispensing system of claim 19, further comprising:

said control assembly including computer controller utilizing pulses associated with a pre-determined amount of said vehicle fluid for permitting dispensing of said vehicle fluid for a pre-determines number of pulses upon reception of said initial value of currency collected by said currency collection assembly.

21. The fluid dispensing system of claim 20, further comprising:

said control assembly including an amount display operationally coupled to said computer controller for showing an amount of vehicle fluid remaining to be dispensed.

22. The fluid dispensing system of claim 19, further comprising:

said control assembly including an accumulating timer for permitting dispensing of said vehicle fluid for a pre-determined period of time upon reception of said initial value of currency collected by said currency collection assembly.

23. The fluid dispensing system of claim 22, further comprising:

said currency collection assembly being operationally coupled to said control assembly whereby said vehicle fluid is dispensable for an additional pre-determined period of time upon reception of an additional currency in excess of said initial value of currency collected by said currency collection assembly.

24. The fluid dispensing system of claim 22, further comprising:

said control assembly including a time display operationally coupled to said accumulating timer for showing an amount of time remaining for dispensing said vehicle fluid.

25. A fluid dispensing system comprising:

a housing;

a tank positioned in said housing, said tank having an interior space adapted for holding a vehicle fluid;

said housing being structured to have an opening in a forward face of said housing;

a dispensing hose assembly coupled to said tank, said dispensing hose assembly including a dispensing hose having a first end in environmental communication with said interior space of said tank whereby said dispensing hose is adapted for dispensing the vehicle fluid through said dispensing hose;

a pump assembly coupled to said dispensing hose for pumping the vehicle fluid through said dispensing hose;

a control assembly operationally coupled to said pump assembly for selectively activating said pump whereby said pump dispenses the vehicle fluid only upon activation by said control assembly;

a cover member couplable to said housing for covering said opening in said forward face such that said control assembly is covered;

a currency collection assembly operationally coupled to said control assembly whereby said control assembly dispenses said vehicle fluid only upon reception of a pre-determined initial value of currency collected by said currency collection assembly;

said currency collection assembly including a currency collection bin coupled to said cover member, said currency collection bin being positionable beneath a main portion of said currency collection assembly when said cover member is engaged to said housing whereby currency passing through said main portion of said currency collection assembly is collected in said currency collection bin;

said control assembly including computer controller utilizing pulses associated with a pre-determined amount of said vehicle fluid for permitting dispensing of said vehicle fluid for a pre-determined number of pulses upon reception of said initial value of currency collected by said currency collection assembly; and a notch extending upwardly into said cover member such that an upper portion of said notch receives said dispensing hose therethrough when said cover member is coupled to said housing.

26. A fluid dispensing system comprising:

a housing;

a tank positioned in said housing, said tank having an interior space adapted for holding a vehicle fluid;

said housing being structured to have an opening in a forward face of said housing;

a dispensing hose assembly coupled to said tank, said dispensing hose assembly including a dispensing hose having a first end in environmental communication with said interior space of said tank whereby said dispensing hose is adapted for dispensing the vehicle fluid through said dispensing hose;

a pump assembly coupled to said dispensing hose for pumping the vehicle fluid through said dispensing hose;

a control assembly operationally coupled to said pump assembly for selectively activating said pump whereby said pump dispenses the vehicle fluid only upon activation by said control assembly;

a cover member couplable to said housing for covering said opening in said forward face such that said control assembly is covered;

a base portion coupled to said housing for supporting said housing above a surface on which said base portion rests;

said base portion being integrally coupled to said housing; and said tank extending into said base portion;

said base portion including a channeled rib extending upward from a bottom of said base portion; and an electrical wire conduit for enclosing electrical wiring, said electrical wire conduit being positioned substantially within said channeled rib, said electrical wire conduit having an upper end extending into said housing.

27. A fluid dispensing system comprising:

a housing;

a tank positioned in said housing, said tank having an interior space adapted for holding a vehicle fluid;

said housing being structured to have an opening in a forward face of said housing;

a dispensing hose assembly coupled to said tank, said dispensing hose assembly including a dispensing hose having a first end in environmental communication with said interior space of said tank whereby said dispensing hose is adapted for dispensing the vehicle fluid through said dispensing hose;

a pump assembly coupled to said dispensing hose for pumping the vehicle fluid through said dispensing hose;

a control assembly operationally coupled to said pump assembly for selectively activating said pump whereby said pump dispenses the vehicle fluid only upon activation by said control assembly;

a cover member couplable to said housing for covering said opening in said forward face such that said control assembly is covered;

said cover member having a pair of orthogonally positioned outer portions;

said housing having a recessed lip, said cover member being positionable into said recessed lip; and said outer portions of said cover member being positioned adjacent to sides of said recessed lip when said cover member is coupled to said housing whereby said outer portions facilitate prevention of removal of said cover member from said housing.

28. A fluid dispensing system comprising:

a housing;

a tank positioned in said housing, said tank having an interior space adapted for holding a vehicle fluid;

said housing being structured to have an opening in a forward face of said housing;

a dispensing hose assembly coupled to said tank, said dispensing hose assembly including a dispensing hose having a first end in environmental communication with said interior space of said tank whereby said dispensing hose is adapted for dispensing the vehicle fluid through said dispensing hose;

a pump assembly coupled to said dispensing hose for pumping the vehicle fluid through said dispensing hose;

a control assembly operationally coupled to said pump assembly for selectively activating said pump whereby said pump dispenses the vehicle fluid only upon activation by said control assembly;

a cover member couplable to said housing for covering said opening in said forward face such that said control assembly is covered;

said tank having a fill opening positioned on a top surface of said tank; and a cap member selectively engageable to said fill opening for covering said fill opening.

29. The fluid dispensing system of claim 28, further comprising:

said cap member having a locking mechanism for preventing removal of said cap member for facilitating access to said tank only by authorized persons for maintenance of said fluid dispensing system.

30. A fluid dispensing system comprising:

a housing;

a tank positioned in said housing, said tank having an interior space adapted for holding a vehicle fluid;

said housing being structured to have an opening in a forward face of said housing;

a dispensing hose assembly coupled to said tank, said dispensing hose assembly including a dispensing hose having a first end in environmental communication with said interior space of said tank whereby said dispensing hose is adapted for dispensing the vehicle fluid through said dispensing hose;

a pump assembly coupled to said dispensing hose for pumping the vehicle fluid through said dispensing hose;

a control assembly operationally coupled to said pump assembly for selectively activating said pump whereby said pump dispenses the vehicle fluid only upon activation by said control assembly; and a cover member couplable to said housing for covering said opening in said forward face such that said control assembly is covered;

a currency collection assembly operationally coupled to said control assembly whereby said control assembly dispenses said vehicle fluid only upon reception of a pre-determined initial value of currency collected by said currency collection assembly;

said currency collection assembly including a currency collection bin coupled to said cover member, said currency collection bin being positionable beneath a main portion of said currency collection assembly when said cover member is engaged to said housing whereby currency passing through said main portion of said currency collection assembly is collected in said currency collection bin;

said control assembly including an accumulating timer for permitting dispensing of said vehicle fluid for a pre-determined period of time upon reception of said initial value of currency collected by said currency collection assembly;

said currency collection assembly being operationally coupled to said control assembly whereby said vehicle fluid is dispensable for an additional pre-determined period of time upon reception of an additional currency in excess of said initial value of currency collected by said currency collection assembly;

said opening in said housing having a channel extending along a bottom of said opening for receiving a bottom of said cover member;

said cover member including a holster portion for receiving a free end of said dispensing hose;

a holster switch coupled to said cover member, said holster switch being operationally coupled to said control assembly for preventing dispensing of said vehicle fluid upon return of said free end of said dispensing hose to said holster portion after use;

a display panel coupled to said cover member, said display panel being operationally coupled to said control assembly for displaying a remaining time for dispensing said vehicle fluid;

a spindle lock coupled to said cover member proximate a top of said cover member, said spindle lock having an interior end portion selectively engageable to an interior wall of said housing for locking said cover member to said housing;

said channel in said opening of said housing having a protrusion;

said bottom of said cover member having a notch for receiving said protrusion when said cover member is coupled to said housing;

said notch extending upwardly into said cover member such that an upper portion of said notch receives said dispensing hose therethrough when said cover member is coupled to said housing;

a transmitter operationally coupled to said control assembly for transmitting status data to a remote location for monitoring use of said fluid dispensing system;

a tank fluid level sensor coupled to said tank for monitoring a level of said vehicle fluid in said tank, said tank level sensor being operationally coupled to said control assembly such that said transmitter transmits a refilling signal to said remote location upon detection of a pre-determined level of fluid in said tank;

said pump assembly including a pump;

said pump assembly including a filter for removing debris from said vehicle fluid, said filter being positioned between said tank and said pump whereby said filter removes debris from said vehicle fluid before said vehicle fluid enters said pump;

said pump assembly including a flow meter for monitoring flow through said pump assembly;

said tank having a fill opening positioned on a top surface of said tank;

a cap member selectively engageable to said fill opening for covering said fill opening;

said cap member having a locking mechanism for preventing removal of said cap member for facilitating access to said tank only by authorized persons for maintenance of said fluid dispensing system;

said control assembly including a time display operationally coupled to said accumulating timer for showing an amount of time remaining for dispensing said vehicle fluid;

said control assembly including an electronic connection port; and a wire coupled between said pump assembly and said control assembly whereby said pump is activatable by said control assembly, said wire having a first end removably insertable into said electronic connection port for facilitating replacement of said control assembly.

31. The fluid dispensing system of claim 30, further comprising:

a base portion coupled to said housing for supporting said housing above a surface on which said base portion rests;

said base portion including a channeled rib extending upward from a bottom of said base portion;

an electrical wire conduit for enclosing electrical wiring, said electrical wire conduit being positioned substantially within said channeled rib, said electrical wire conduit having an upper end extending into said housing.

32. The fluid dispensing system of claim 30, further comprising:

a main mounting bracket adapted for coupling to a surface, said housing being coupled to said main mounting bracket;

wherein said main mounting bracket includes a medial portion adapted for coupling to an outer surface of a structure, said main mounting bracket further including a pair of outer portions extending from said medial portion, said outer portions being coupled to said housing;

wherein said medial portion of said main mounting bracket includes a pair of planar outside portions and a recessed central portion between said planar outside portions;

said central recessed portion including a pair of spaced vertical parallel structure bracket walls extending said planar outside portions whereby said central recessed portion is adapted for receiving a generally rectangular shaped structure;

said central recessed portion having an arcuate curvature whereby said central recessed portion is adapted for receiving a generally arcuately shaped outer face of said structure.

* * * * *